US010029273B2

(12) United States Patent
Birkner et al.

(10) Patent No.: US 10,029,273 B2
(45) Date of Patent: Jul. 24, 2018

(54) END EFFECTOR CLEANING DEVICES AND SYSTEMS

(71) Applicant: Toyota Motor Engineering & Manufacturing North America, Inc., Erlanger, KY (US)

(72) Inventors: John Birkner, Evansville, IN (US); Dan Eck, Springerton, IL (US); Mary Tumey, Vincennes, IN (US); Mark Clayton, Elberfeld, IN (US); Scott Huck, Evansville, IN (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 140 days.

(21) Appl. No.: 15/198,650

(22) Filed: Jun. 30, 2016

(65) Prior Publication Data

US 2017/0001212 A1 Jan. 5, 2017

Related U.S. Application Data

(60) Provisional application No. 62/186,634, filed on Jun. 30, 2015.

(51) Int. Cl.
*B05B 15/02* (2006.01)
*B05B 15/52* (2018.01)

(52) U.S. Cl.
CPC ..... *B05B 15/52* (2018.02); *B05B 15/0208* (2013.01)

(58) Field of Classification Search
CPC ..... B05B 15/52; B05B 15/50; B05B 15/58
USPC ..... 15/97.1
See application file for complete search history.

(56) References Cited

U.S. PATENT DOCUMENTS 5,046,211 A 9/1991 Steinhart et al.
5,438,725 A * 8/1995 Okada ..... B08B 1/008 15/104.04
5,926,894 A * 7/1999 Justin ..... B08B 1/00 15/53.1
6,292,976 B1 9/2001 Kurcz et al.
6,491,204 B1 * 12/2002 Erdmann ..... B23K 1/018 15/102
7,472,736 B2 1/2009 Kisch et al.
7,993,466 B2 * 8/2011 Aude ..... B05B 15/52 134/6
2003/0127046 A1 * 7/2003 Zehner ..... B08B 1/04 118/302
2012/0037183 A1 * 2/2012 Foley ..... B08B 1/00 134/6

(Continued)

*Primary Examiner* — Weilun Lo
(74) *Attorney, Agent, or Firm* — Dinsmore & Shohl LLP

(57) ABSTRACT

An end effector cleaner for removing excess sealant from an end effector is provided. The end effector cleaner includes a first spool, a second spool, a medium for removing excess sealant from the end effector, a support member configured to support a portion of the medium, a motor for rotating the second spool, an advancement sensor for detecting a presence of the end effector and sending a signal for rotating the motor, and a roll sensor for detecting a dimension of the medium wound on at least one of the first spool and the second spool. One end of the medium is wound on the first spool and the other end of the medium is wound on the second spool, and the portion of the medium is positioned to receive excess sealant of the end effector.

20 Claims, 4 Drawing Sheets

(56) References Cited

U.S. PATENT DOCUMENTS

2014/0124537 A1 5/2014 Urquhart et al.
2015/0314888 A1* 11/2015 Reid ..... B64F 5/0009
700/117

* cited by examiner

END EFFECTOR CLEANING DEVICES AND SYSTEMS

CROSS-REFERENCE TO RELATED APPLICATIONS

This application claims priority to U.S. Provisional Patent Application No. 62/186,634 filed on Jun. 30, 2015 and entitled "End Effector Cleaning Devices and Systems," the entire contents of which are hereby incorporated by reference.

TECHNICAL FIELD

The present specification generally relates to devices and systems for cleaning an end effector, and more particularly, to devices and systems for cleaning the end effector of a sealant dispensing robot.

BACKGROUND

Sealer and/or sealant may be applied to a vehicle body as part of a manufacturing process. In one example, the sealer and/or sealant may include a polymer or other suitable material that is applied to various joints of the body to seal and weatherproof the vehicle. A robot may be utilized to apply the sealer to the vehicle body, dispensing the sealer and/or sealant through an end effector of the robot. The robot applies the sealer to sequential vehicle bodies in an assembly line, the robot applying sealant to individual vehicle bodies in a predetermined cycle. Between cycles, i.e., between individual vehicle bodies, excess sealant and/or debris may remain on the end effector of the robot and must be removed prior to the application of sealant to the next vehicle.

Accordingly, a need exists for alternative end effector cleaners for cleaning excess sealant from an end effector.

SUMMARY

In one embodiment, an end effector cleaner for removing excess sealant from an end effector is provided. The end effector cleaner includes a first spool, a second spool, a medium for removing excess sealant from the end effector, a support member configured to support a portion of the medium, a motor coupled to the second spool for rotating the second spool, an advancement sensor for detecting a presence of the end effector and sending a signal for rotating the motor, and a roll sensor for detecting a dimension of the medium wound on at least one of the first spool and the second spool. One end of the medium is wound on the first spool and the other end of the medium is wound on the second spool, the medium extends along a medium conveyance pathway between the first spool and the second spool, and the portion of the medium is positioned to receive excess sealant from the end effector. The support member is positioned adjacent to the medium conveyance pathway between the first spool and the second spool such that the medium traverses the medium conveyance pathway. The advancement sensor is communicatively coupled to the motor. The end effector cleaner facilitates automatically removing excess sealant on the end effector, and thus, heightens the speed of applying sealant on vehicles by the end effector every cycle.

According to another embodiment, an end effector cleaner system is provided. The end effector cleaner system includes an end effector for dispensing sealant, and an end effector cleaner for removing excess sealant from the end effector.

The end effector cleaner includes a first spool, a second spool, a medium for removing excess sealant from the end effector, a support member configured to support a portion of the medium, a motor for rotating the second spool, and an advancement sensor for detecting a presence of the end effector and sending a signal for rotating the motor. The advancement sensor is communicatively coupled to the motor. One end of the medium is wound on the first spool and the other end of the medium is wound on the second spool, the medium extends along a medium conveyance pathway between the first spool and the second spool, and the portion of the medium is positioned to receive excess sealant from the end effector. The support member is positioned adjacent to the medium conveyance pathway between the first spool and the second spool such that the medium traverses the medium conveyance pathway. The motor is coupled to the second spool. The advancement sensor is communicatively coupled to the motor.

According to another embodiment, a method for cleaning an end effector of a robot is provided. The method includes: moving, by the robot, the end effector into contact with a portion of a medium between successive applications of sealant by the end effector, wherein one end of the medium is wound on a first spool and the other end of the medium is wound on a second spool, the medium extends along a medium conveyance pathway between the first spool and the second spool, and the portion of the medium is supported by a support member positioned adjacent to the medium conveyance pathway between the first spool and the second spool, detecting, by an advancement sensor of an end effector cleaner, a presence of the end effector, and rotating, by a motor of the end effector cleaner, the second spool by a degree in response to detection of the presence of the end effector.

In embodiments, the medium may be a ribbon which includes at least one of a cloth ribbon, a felt ribbon, a paper-based ribbon, or a polymer-based ribbon. The advancement sensor may include an actuator configured to move in response to a contact with the end effector, and the advancement sensor may send a signal for rotating the motor based on the movement of the actuator. The motor may be configured to rotate the second spool based on the signal received from the advancement sensor. The dimension of the medium wound on the second spool detected by the roll sensor may include a diameter of the medium wound on the second spool and the motor is rotated based on the diameter of the medium wound on the second spool. The dimension of the medium wound on the first spool detected by the roll sensor may include a diameter of the medium wound on the first spool and the motor is rotated based on the diameter of the medium wound on the first spool. The advancement sensor may be a photoelectric sensor or a laser sensor. The end effector cleaner may further include an engagement arm configured to contact an outer circumference of the medium wound on the second spool, and the roll sensor may be further configured to detect a position of the engagement arm. The motor may be configured to rotate the second spool by a degree determined based on the detected position of the engagement art.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 2:
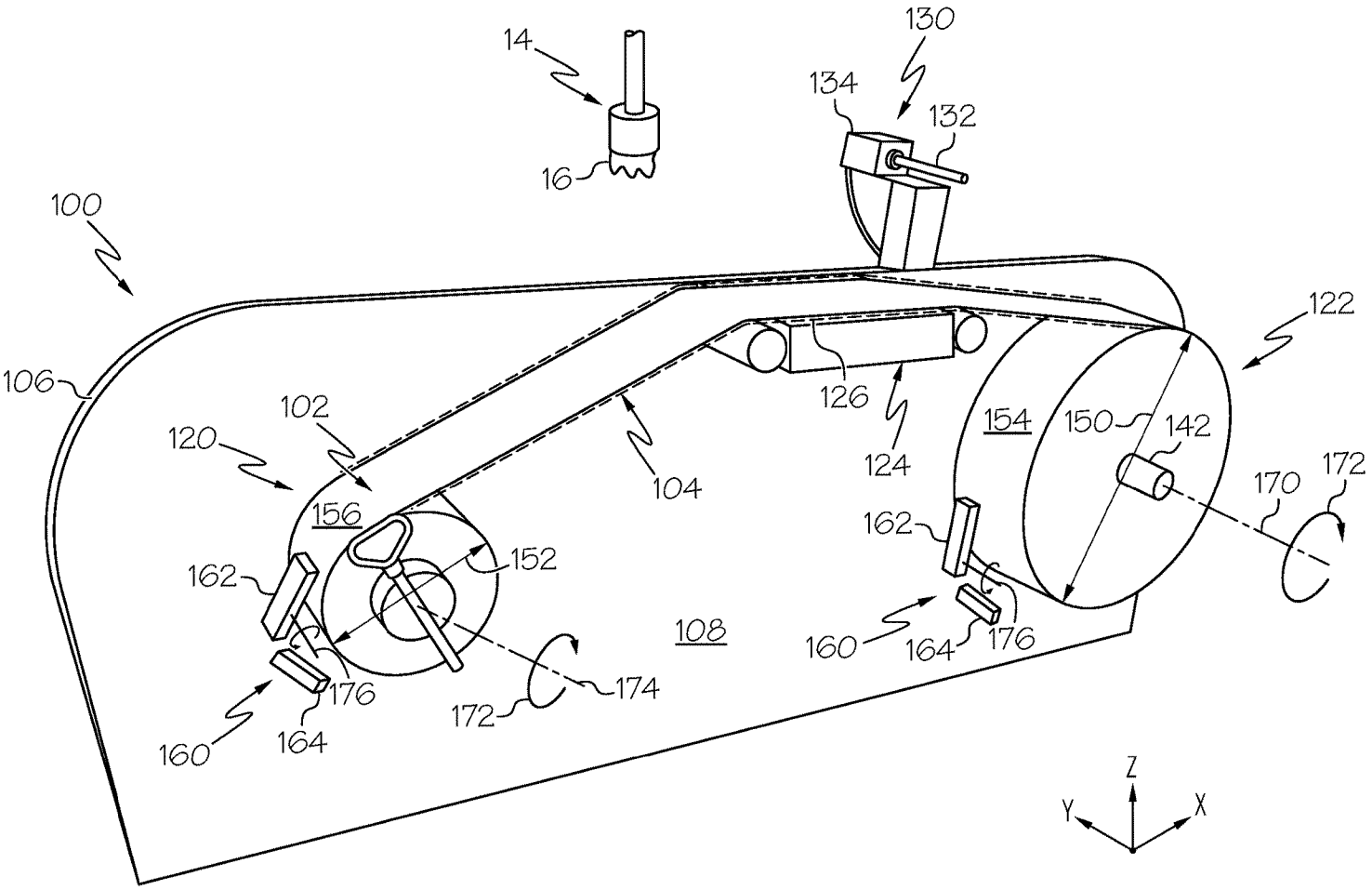
FIG. 2 schematically depicts a perspective view of one of the end effector cleaners of FIG. 1, according to one or more embodiments shown or described herein.

FIG. 2 schematically depicts one embodiment of an end effector cleaner which may be used, for example, in an end effector cleaner system for removing excess adhesive from an end effector used for applying sealant to, for example, a vehicle during assembly. The end effector cleaners according to the present specification may generally include a first spool, a second spool, and a support member that are coupled to a base frame, where the first spool is spaced apart from the second spool in a longitudinal direction. The support member is positioned between the first spool and the second spool in the longitudinal direction, and the first spool, the second spool, and the support member define a ribbon conveyance pathway with the support member positioned adjacent to the ribbon conveyance pathway. The end effector cleaner further includes an advancement sensor coupled to the base frame, and a motor coupled to the base frame and engaged with the second spool. The motor is communicatively coupled to the advancement sensor and the motor rotates the second spool based on a signal from the advancement sensor. By rotating the second spool, a ribbon extending along the ribbon conveyance pathway is taken up by the second spool and clean ribbon wound on the first spool is paid out and advances along the ribbon conveyance pathway. By taking up ribbon on the second spool and paying out clean ribbon from the first spool, clean ribbon may be continually provided on the ribbon conveyance pathway, providing a clean medium for removing excess sealant from an end effector of a robot. These and other embodiments will be described in more detail below with reference to the appended drawings.

As used herein, the term "longitudinal direction" refers to the forward-rearward direction of the end effector cleaner (i.e., in the +/−X-direction as depicted). The term "lateral direction" refers to the cross-cleaner direction (i.e., in the +/−Y-direction as depicted), and is transverse to the longitudinal direction. The term "vertical direction" refers to the upward-downward direction (i.e., in the +/−Z-direction as depicted).

The phrase "communicatively coupled" is used herein to describe the interconnectivity of various components of the end effector cleaner and/or end effector cleaner system and means that the components are connected either through wires, optical fibers, or wirelessly such that electrical, optical, and/or electromagnetic signals may be exchanged between the components.

Figure 1:
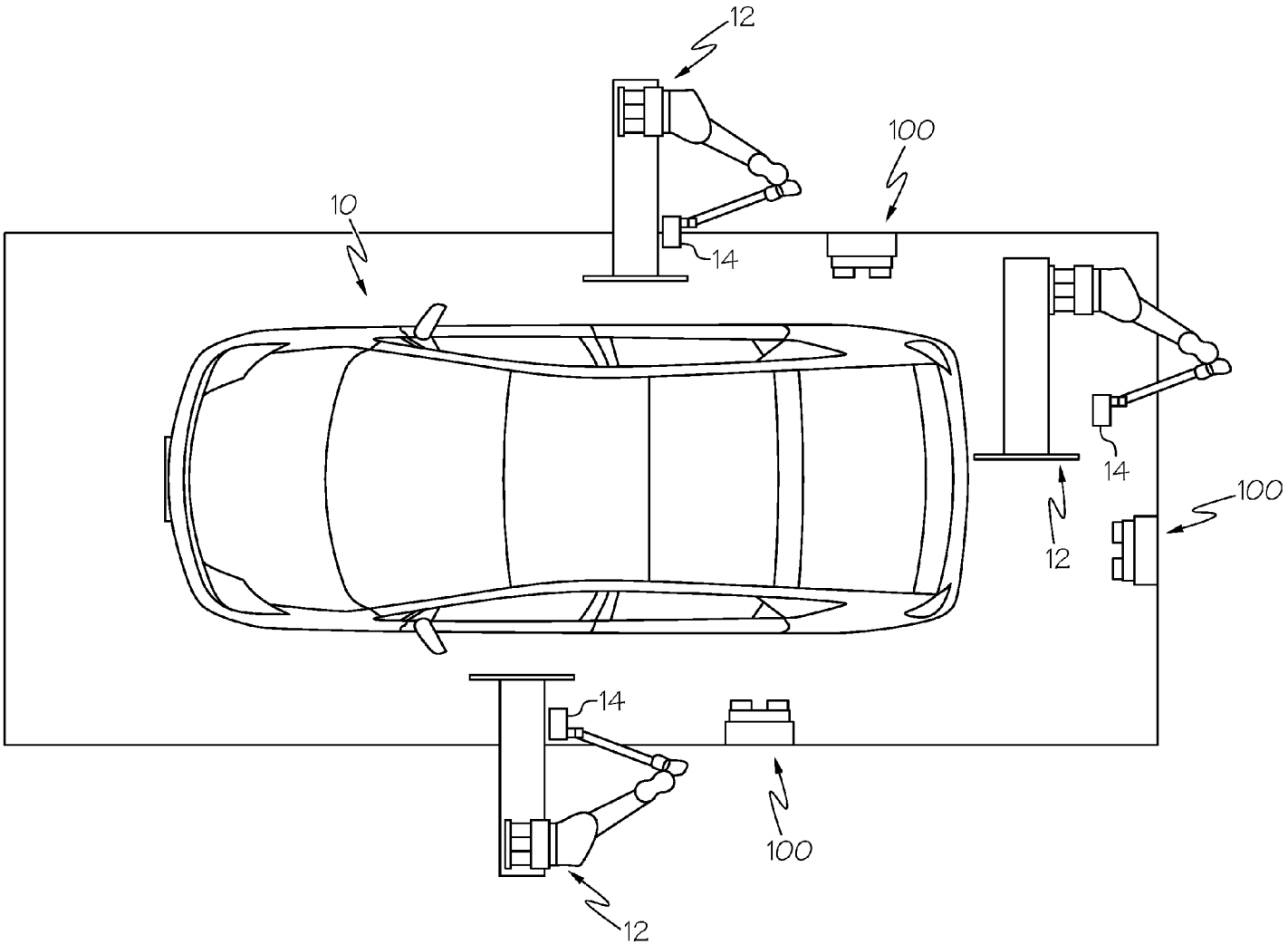
FIG. 1 schematically depicts robots applying a sealant to the vehicle body and end effector cleaners for removing excess sealant and debris from the end effectors, according to one or more embodiments shown or described herein.

Referring initially to FIG. 1, a vehicle body 10 is depicted within a robot cell. As part of the manufacturing process, robots 12 within the robot cell apply a sealant to portions of the vehicle body 10 to seal and/or weatherproof the vehicle body 10. Each of the robots 12 include an end effector 14 that dispenses and applies the sealant to the vehicle body 10. Once the application of sealant at a particular location is complete, the robot 12 may discontinue dispensing the sealant and move to another location. However, despite discontinuing the dispensing of sealant, excess sealant may still be dispensed from the end effector 14, causing an undesired build up of excess on the end effector 14. This excess sealant may affect the subsequent dispensing of sealant by the end effector and/or cause excess sealant to be applied to the vehicle body 10 at locations other than desired application location. Accordingly, between application of sealant to individual vehicle bodies 10, the end effectors 14 are cleaned with end effector cleaners 100, removing excess sealant from the end effector 14. As such, one or more end effector cleaners 100 are positioned proximate to each of the robots 12 to remove excess sealant from the end effectors 14.

Referring to FIG. 2, one embodiment of an end effector cleaner 100 is schematically depicted. The end effector cleaner 100 may generally include a first spool 120, a second spool 122, and a support member 124 coupled to a base frame 106 of the end effector cleaner 100. The first spool 120, the second spool 122, and the support member 124 are coupled to a front side 108 of the base frame 106, and the first spool 120 is spaced apart from the second spool 122 in the longitudinal direction. The first spool 120 and the second spool 122 are rotatably coupled to the base frame 106 of the end effector cleaner 100. In particular, the first spool 120 is rotatably coupled to the base frame 106 such that the first spool 120 rotates about an axis 174 and the second spool 122 is rotatably coupled to the base frame 106 such that the second spool 122 rotates about an axis 170. In embodiments, both the axis 170 and the axis 174 extend in the lateral direction and are generally parallel with one another.

The support member 124 is coupled to the front side 108 of the base frame 106 and is positioned between the first spool 120 and the second spool 122 in the longitudinal direction. In embodiments, the support member 124 is rigidly coupled to the base frame 106 such that the support member 124 is stationary relative to the first spool 120 and the second spool 122. The support member 124 includes a support surface 126 that extends across the support member 124 in the longitudinal direction and the lateral direction. In embodiments, the support surface 126 of the support member 124 is oriented to face upwards in the vertical direction.

The first spool 120, the second spool 122, and the support member 124 define a ribbon conveyance pathway 104 on which a ribbon 102 is conveyed between the first spool 120 and the second spool 122. The ribbon 102 is wound on the first spool 120 and the second spool 122 and in operation, at least a portion of the ribbon 102 extends between the first spool 120 and the second spool 122 in the longitudinal direction. In particular, at least a portion of the ribbon 102 extends along the ribbon conveyance pathway 104 between the first spool 120 and the second spool 122, over the support surface 126 of the support member 124. That is, the support member 124 and the support surface 126 are positioned adjacent to the ribbon conveyance pathway 104 such that the ribbon 102 passes over the support surface 126 as it is conveyed along the ribbon conveyance pathway 104 between the first spool 120 and the second spool 122. In embodiments, the ribbon 102 may be formed from materials including, but not limited to, a cloth ribbon, a felt ribbon, a paper-based ribbon, a polymer-based ribbon, or the like. The ribbon 102 is used to remove excess sealant 16 on the end effector 14 of the robot 12 (FIG. 1), as will be described in greater detail herein.

Figure 3:
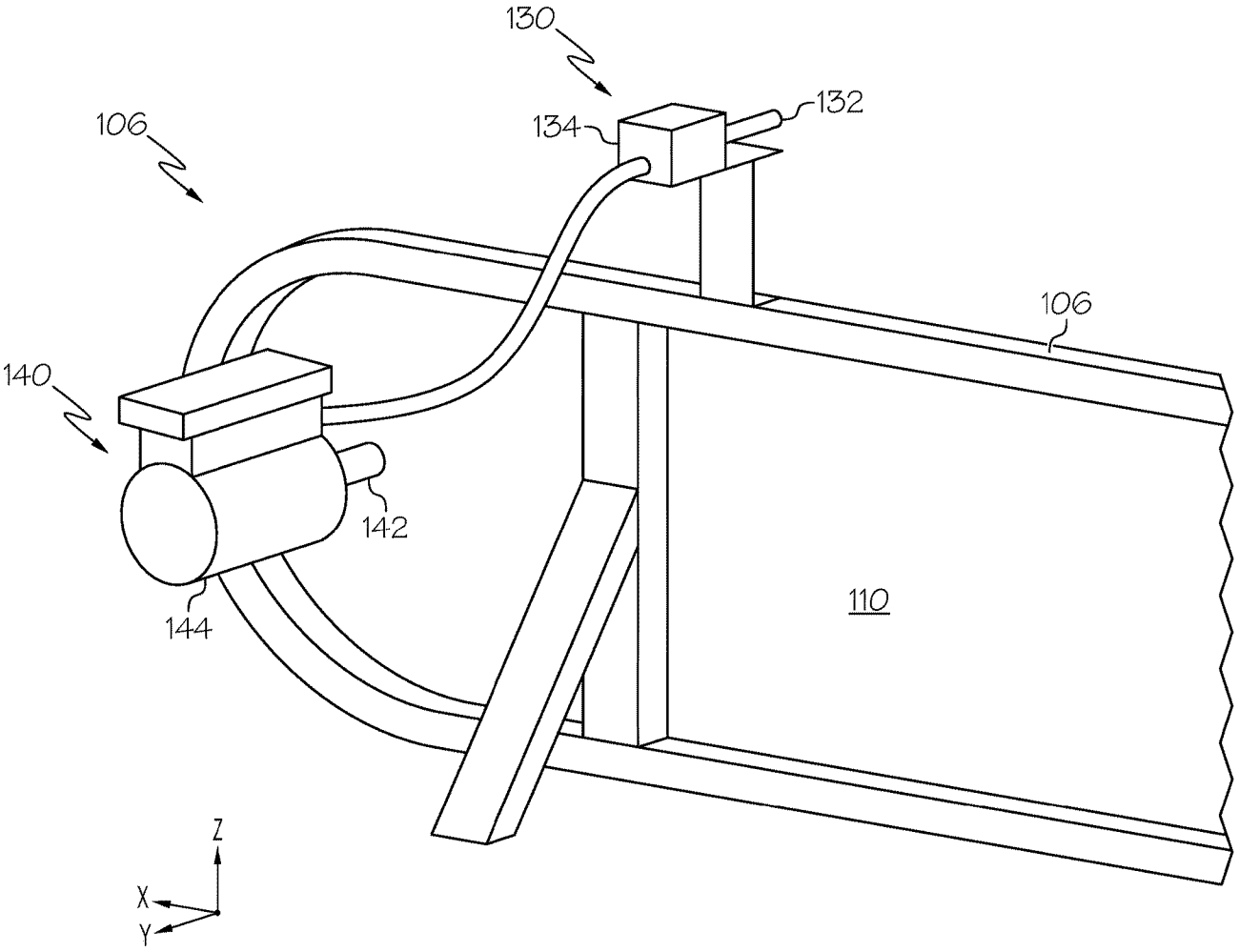
FIG. 3 schematically depicts a rear perspective view of the end effector cleaner of FIG. 3, according to one or more embodiments shown or described herein.

Referring collectively to FIGS. 2 and 3, a motor 140 is coupled to a rear side 110 of the base frame 106. The motor 140 includes a motor body 144 and a shaft 142 that is rotatable with respect to the motor body 144. In the embodiment depicted in FIG. 3, the shaft 142 extends in the lateral direction and is positioned at least partially within the base frame 106. The shaft 142 extends through the rear side 110 of the base frame 106 to the front side 108 of the base frame 106, and is engaged with the second spool 122. In particular, at least a portion of the shaft 142 contacts and is engaged with the second spool 122, such that when the shaft 142 rotates, the second spool 122 rotates about the axis 170. While the shaft 142 is described and depicted as directly contacting and engaging the second spool 122, it should be understood that in some embodiments, the shaft 142 may be coupled to one or more mechanical linkages (not depicted) that contact and engage the second spool 122, such that the shaft 142 contacts and engages the second spool 122 through the one or more mechanical linkages. In embodiments, the motor 140 includes an electric motor, such as an AC motor, a DC motor, or the like. The motor 140 may be, for example, a standalone motor 140 with an integral motor controller that facilitates operation of the motor 140. Alternatively, a separate motor controller (not depicted) may be communicatively coupled to the motor 140. The motor controller (whether separate or stand alone) includes a processor and a memory storing a computer readable and executable instruction set, which when executed by the processor, facilitates operation of the motor 140.

The end effector cleaner 100 includes an advancement sensor 130 that is coupled to the base frame 106 of the end effector cleaner 100. In the embodiment depicted in FIG. 2, the advancement sensor 130 includes a limit switch including a sensor body 134 and an arm or actuator 132 that extends outward from the front side 108 of the base frame 106 in the lateral direction. While the actuator 132 of the advancement sensor 130 is described and depicted as extending primarily in the lateral direction, it should be understood that the actuator 132 may also extend in the longitudinal direction and/or the vertical direction.

Figure 4:
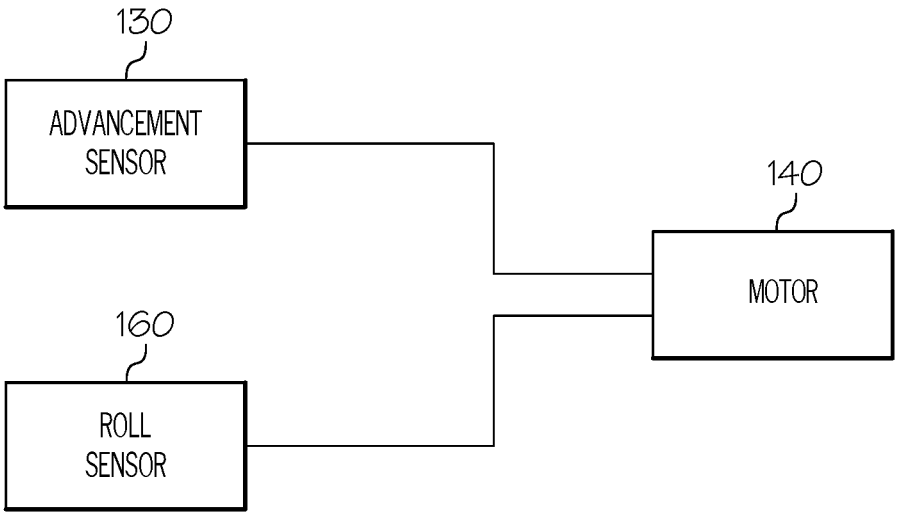
FIG. 4 schematically depicts a block diagram of the end effector cleaner of FIG. 2 according to one or more embodiments shown or described herein.

Referring to FIG. 4, the advancement sensor 130 is communicatively coupled to the motor 140 (such as a controller operatively associated with the motor). The advancement sensor 130 sends a signal to the controller operatively associated with the motor 140 instructing the motor 140 to rotate the shaft 142. In particular, when the actuator 132 is displaced from its original orientation, the advancement sensor 130 sends a signal to the controller operatively associated with the motor 140, instructing the motor 140 to rotate the shaft 142 in direction 172 about the axis 170. While the advancement sensor 130 is described and depicted as including a limit switch, it should be understood that the advancement sensor 130 may include various sensors that send a signal upon receiving an input, the sensors including, but not limited to, photoelectric sensors, laser sensors, or the like.

Referring to FIG. 2, in some embodiments, the end effector cleaner 100 may further include a roll sensor 160 coupled to the base frame 106. The roll sensor 160 detects a diameter 150 of the ribbon 102 wound on the second spool 122. In the embodiment depicted in FIG. 2, the roll sensor 160 includes an engagement arm 162 and a sensor portion 164. The engagement arm 162 is pivotally coupled to the front side 108 of the base frame 106 and at least a portion of the engagement arm 162 contacts an outer circumference 154 of the ribbon 102 wound on the second spool 122. When the diameter 150 of the ribbon 102 wound on the second spool 122 increases or decreases, the outer circumference 154 will increase or decrease. As the engagement arm 162 is engaged with the outer circumference 154 and is pivotally coupled to the base frame 106, when the outer circumference 154 increases or decreases, the engagement arm 162 pivots about axis 176 with respect to the base frame 106. As the engagement arm 162 pivots about axis 176, at least a portion of the engagement arm 162 moves toward or away from the sensor portion 164. Based on the position of the engagement arm 162 with respect to the sensor portion 164, the roll sensor 160 may detect an increase or decrease in dimension of the outer circumference 154 of the ribbon 102 wound on the second spool 122, which is indicative of an increase or decrease in the dimension of the diameter 150 of the ribbon 102 wound on the second spool 122. The sensor portion 164 of the roll sensor 160 may include various sensors suitable to detect a position of the engagement arm 162, including, but not limited to, a proximity sensor, a linear variable differential transducer, a photoelectric sensor, or the like. While the roll sensor 160 is described and depicted as including an engagement arm 162 that contacts the outer circumference 154 of the ribbon 102 wound on the second spool 122, it should be understood that the roll sensor 160 may include a non-contact sensor that directly detects the diameter 150 of the ribbon 102 wound on the second spool 122, such as a photoelectric sensor, a vision system, or the like. Further, while the roll sensor 160 is described and depicted as detecting a dimension of the outer circumference 154 and the diameter 150 of the ribbon 102 wound on the second spool 122, a roll sensor 160 may alternatively or additionally detect a dimension of an outer circumference 156 and a diameter 152 of the ribbon 102 wound on the first spool 120.

Referring to FIG. 4, the roll sensor 160 is communicatively coupled to the motor 140 (such as a controller operatively associated with the motor) and sends a signal indicative of the diameter 150 of the ribbon 102 wound on the second spool 122 and/or a signal indicative of the diameter 152 of the ribbon 102 wound on the first spool 120. Based on the signal from the roll sensor 160, the controller operatively associated with the motor 140 may increase or decrease an angular distance that the shaft 142 rotates when the motor 140 rotates the second spool 122, as will be described in greater detail herein.

Although FIG. 2 illustrates two roll sensors 160 associated with the first spool 120 and the second spool 122 respectively, in some embodiments, one roll sensor 160 may be associated with the first spool 120 or the second spool 122. For example, one roll sensor 160 is located proximate to the second spool 122, but no roll sensor is located proximate to the first spool 122. The motor 140 may receive a signal from the roll sensor 160 proximate to the second spool 122, and operates based on the signal. In other example, one roll sensor 160 is located proximate to the first spool 122, but no roll sensor is located proximate to the second spool 122. The motor 140 may receive a signal from the roll sensor 160 proximate to the first spool 122, and operates based on the signal. In some embodiments, one roll sensor 160 is associated with both the first spool 120 and the second spool 122 and sends a signal indicative of the diameter 152 of the ribbon 102 wound on the first spool 120 and a signal indicative of the diameter 150 of the ribbon wound on the second spool 122.

Referring again to FIGS. 2 and 3, in operation, the end effector cleaner 100 provides a medium, i.e., the ribbon 102, to clean excess sealant 16 from the end effector 14 of the robot 12. The robot 12 moves the end effector 14 towards the end effector cleaner 100. The end effector 14 contacts the ribbon 102 on the ribbon conveyance pathway 104. For example, the robot 12 may be programmed to move the end effector 14 into contact with the ribbon 102 on the ribbon conveyance pathway 104 between successive applications of sealant. In embodiments, the end effector 14 contacts the portion of the ribbon 102 that extends over the support surface 126 of the support member 124. That is, the support surface 126 of the support member 124 supports the portion of the ribbon 102 that the end effector 14 contacts, thereby preventing the end effector 14 from puncturing or tearing the ribbon 102. By contacting the ribbon 102, the end effector 14 deposits and/or wipes the excess sealant 16 from the end effector 14 onto the portion of the ribbon 102 that extends over the support surface 126 of the support member 124. In embodiments, the robot may be programmed to traverse the end effector 14 over the surface of the ribbon 102 to facilitate a wiping motion.

Once the end effector 14 has contacted and wiped the excess sealant 16 onto the ribbon 102, the robot 12 moves the end effector 14 toward the advancement sensor 130. In the embodiment depicted in FIG. 2, the end effector 14 moves in the longitudinal direction toward the advancement sensor 130 and provides an input to the advancement sensor 130. In embodiments, the end effector 14 contacts the actuator 132 of the advancement sensor 130, displacing the actuator 132 from its original orientation. When the advancement sensor 130 includes a photoelectric sensor or a laser sensor, the end effector 14 may provide an input to the advancement sensor by passing through a predetermined area relative to the advancement sensor 130, the predetermined area being defined by the "view" of the photoelectric sensor or the light projected by the laser sensor.

Upon receiving an input from the end effector 14, the advancement sensor 130 sends a signal to the controller operatively associated with the motor 140. The controller instructs the motor 140 to rotate the shaft 142, and accordingly the second spool 122. In particular, the motor 140 rotates the second spool 122 in direction 172 about the axis 170. As the second spool 122 rotates in direction 172, the second spool 122 takes up the ribbon 102 that is extended over the support member 124 with the excess sealant 16, advancing the ribbon 102 along the ribbon conveyance pathway 104 in the longitudinal direction (i.e., in the +X-direction as depicted). As the ribbon 102 advances, the ribbon 102 that is wound on the first spool 120 is paid out from the first spool 120 and the first spool 120 rotates about the axis 174 in direction 172. The controller rotates the motor 140 a sufficient amount such that clean ribbon 102 paid out from the first spool 120 extends over the support member 124. In this way, soiled ribbon 102 is taken up by the second spool 122, while clean ribbon 102 from the first spool 120 is paid out and extends over the support member 124 after each cycle.

As ribbon 102 is taken up by the second spool 122 and is paid out by the first spool 120, the diameter 150 of the ribbon 102 wound on the second spool 122 will increase in dimension and the diameter 152 of the ribbon 102 wound on the first spool 120 will decrease in dimension. As the diameter 150 of the ribbon 102 wound on the second spool 122 increases, the amount or ribbon 102 taken up by the second spool 122 will increase for each revolution of the shaft 142 of the motor 140. As described hereinabove, in embodiments, the end effector cleaner 100 includes a roll sensor 160 that detects a dimension of the outer circumference 154 of the ribbon 102 wound on the second spool 122. As the diameter 150 and the outer circumference 154 of the ribbon 102 wound on the second spool 122 increase in dimension, the roll sensor 160 sends a signal to the controller operatively associated with the motor 140 and indicative of the increased dimension of the outer circumference 154, instructing the motor 140 to reduce the angular rotation of the shaft 142 during each cycle to account for the increases diameter of the ribbon wound on the second spool 122. Similarly, in embodiments that include a roll sensor 160 that detects an outer circumference 156 of the ribbon 102 wound on the first spool 120, the roll sensor 160 sends a signal to the controller operatively associated with motor 140 indicative of the decreased dimension of the outer circumference 156 instructing the motor 140 to reduce the angular rotation of the shaft 142 during each cycle. By reducing the angular rotation of the shaft 142, the amount of ribbon 102 taken up by the second spool 122 may remain substantially the same as the diameter 150 of the ribbon 102 wound on the second spool 122 increases.

In some embodiments, in response to the signal from the advancement sensor 130, the motor 140 may rotate the shaft 142 by a certain angular degree. The angular degree may be calculated based on the current diameter 150 of the ribbon 102 and the longitudinal length of the support surface 126 of the support member 124. Specifically, the longitudinal length of the ribbon 102 taken up by the second spool 122 each cycle should be the same as or longer than the longitudinal length of the support surface 126 of the support member 124. Thus, the following equation may be provided, which equation may govern the operation and rotational advancement of the motor.

$$\pi \times D \times \frac{\theta}{360^\circ} \geq L \qquad \text{[Equation 1]}$$

Where, D is the current diameter 150 of the ribbon 102 wound on the second spool 122, L is a longitudinal length of the support surface 126 of the support member 124, and 0 is the angular degree that the motor is advanced. Then, the angular degree θ should meet the following equation.

$$\theta \geq \frac{L}{\pi \times D} \times 360^\circ \qquad \text{[Equation 2]}$$

Between cycles, i.e., between the application of sealant to individual vehicle bodies, the end effector cleaner removes excess sealant and/or debris on the end effector of the robot. By rotating the second spool by a certain angular amount each cycle, a clean ribbon is supplied on the support member, and additional excess sealant on the end effector can be removed by the clean ribbon. In this regard, the end effector cleaner facilitates removing excess sealant on the end effector every cycle, and thus, the overall process of applying sealant on vehicles by the end effector can be accelerated.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An end effector cleaner for removing excess sealant from an end effector, the end effector cleaner comprising:

a first spool;

a second spool;

a medium for removing excess sealant from the end effector, wherein one end of the medium is wound on the first spool and the other end of the medium is wound on the second spool, the medium extending along a medium conveyance pathway between the first spool and the second spool;

a support member positioned adjacent to the medium conveyance pathway between the first spool and the second spool such that the medium traverses the medium conveyance pathway, the support member configured to support a portion of the medium, wherein the portion of the medium is positioned to receive excess sealant from the end effector;

a motor coupled to the second spool for rotating the second spool;

an advancement sensor communicatively coupled to the motor, the advancement sensor for detecting a presence of the end effector and sending a signal for rotating the motor; and a roll sensor communicatively coupled to the motor, the roll sensor for detecting a dimension of the medium wound on at least one of the first spool and the second spool.

2. The end effector cleaner of claim 1, wherein the medium is a ribbon.

3. The end effector cleaner of claim 2, wherein the ribbon comprises at least one of a cloth ribbon, a felt ribbon, a paper-based ribbon, or a polymer-based ribbon.

4. The end effector cleaner of claim 1, wherein the advancement sensor comprises an actuator configured to move in response to a contact with the end effector, and the advancement sensor sends a signal for rotating the motor based on the movement of the actuator.

5. The end effector cleaner of claim 1, wherein the motor is configured to rotate the second spool based on the signal received from the advancement sensor.

6. The end effector cleaner of claim 5, wherein the dimension of the medium wound on the second spool detected by the roll sensor includes a diameter of the medium wound on the second spool, and the motor is rotated based on the diameter of the medium wound on the second spool.

7. The end effector cleaner of claim 5, wherein the dimension of the medium wound on the first spool detected by the roll sensor includes a diameter of the medium wound on the first spool, and the motor is rotated based on the diameter of the medium wound on the first spool.

8. The end effector cleaner of claim 1, wherein the advancement sensor comprises a photoelectric sensor.

9. The end effector cleaner of claim 1, wherein the advancement sensor comprises a laser sensor.

10. The end effector cleaner of claim 1, further comprising an engagement arm configured to contact an outer circumference of the medium wound on the second spool, wherein the roll sensor is further configured to detect a position of the engagement arm.

11. The end effector cleaner of claim 10, wherein the motor is configured to rotate the second spool by a degree determined based on the detected position of the engagement arm.

12. An end effector cleaner system comprising:

an end effector for dispensing sealant; and an end effector cleaner for removing excess sealant from the end effector, the end effector comprising:

a first spool;

a second spool;

a medium for removing excess sealant from the end effector, wherein one end of the medium is wound on the first spool and the other end of the medium is wound on the second spool, the medium extending along a medium conveyance pathway between the first spool and the second spool;

a support member positioned adjacent to the medium conveyance pathway between the first spool and the second spool such that the medium traverses the medium conveyance pathway, the support member configured to support a portion of the medium, wherein the portion of the medium is positioned to receive excess sealant from the end effector;

a motor coupled to the second spool for rotating the second spool; and an advancement sensor communicatively coupled to the motor, the advancement sensor for detecting a presence of the end effector and sending a signal for rotating the motor, the advancement sensor communicatively coupled to the motor.

13. The end effector cleaner system of claim 12, wherein the end effector cleaner further comprises a roll sensor configured to detect a dimension of the medium wound on the second spool, and the motor is configured to rotate the second spool by a varying degree each cycle based on the dimension of the medium wound on the second spool.

14. The end effector cleaner system of claim 12, wherein the end effector cleaner further comprises an engagement arm configured to contact an outer circumference of the medium wound on the second spool, and a roll sensor configured to detect a position of the engagement arm, and wherein the motor is configured to rotate the second spool by a varying degree based on the position of the engagement arm.

15. The end effector cleaner system of claim 12, wherein the motor is configured to rotate the second spool by a varying degree based on a length of the portion of the medium supported by the support member.

16. The end effector cleaner system of claim 13, wherein the end effector cleaner further comprises a second roll sensor configured to detect a dimension of the medium wound on the first spool.

17. The end effector cleaner system of claim 13, wherein the roll sensor is one of a proximity sensor, a linear variable differential transducer, or a photoelectric sensor.

18. A method for cleaning an end effector of a robot, comprising:

moving, by the robot, the end effector into contact with a portion of a medium between successive applications of sealant by the end effector, wherein one end of the medium is wound on a first spool and the other end of the medium is wound on a second spool, the medium extends along a medium conveyance pathway between the first spool and the second spool, and the portion of the medium is supported by a support member positioned adjacent to the medium conveyance pathway between the first spool and the second spool;

detecting, by an advancement sensor of an end effector cleaner, a presence of the end effector; and rotating, by a motor of the end effector cleaner, the second spool by a degree in response to detection of the presence of the end effector.

19. The method of claim 18, further comprising detecting, by a roll sensor, a dimension of the medium wound on one of the first spool and the second spool.

20. The method of claim 19, wherein the degree is determined based on the detected dimension.

* * * * *